United States Patent [19]

Haneda et al.

[11] Patent Number: 4,738,911

[45] Date of Patent: Apr. 19, 1988

[54] PHOTORECEPTOR FOR ELECTROPHOTOGRAPHY AND AN IMAGE-FORMING PROCESS BY THE USE THEREOF USING COLOR SEPARATION FILTER

[75] Inventors: Satoshi Haneda; Kunihisa Yoshino, both of Tokyo, Japan

[73] Assignee: Konishiroku Photo Industry Co., Ltd., Tokyo, Japan

[21] Appl. No.: 924,354

[22] Filed: Oct. 28, 1986

[30] Foreign Application Priority Data

Oct. 31, 1985 [JP] Japan ..... 60-245178
Mar. 6, 1986 [JP] Japan ..... 61-49092

[51] Int. Cl.[4] ..... G03G 13/01
[52] U.S. Cl. ..... 430/44; 430/46; 430/58
[58] Field of Search ..... 430/58, 43, 44, 46

[56] References Cited

U.S. PATENT DOCUMENTS 3,918,910 11/1975 Anzai ..... 430/46
4,307,165 12/1981 Blazey et al. ..... 430/45

*Primary Examiner*—J. David Welsh
*Attorney, Agent, or Firm*—Jordan B. Bierman

[57] ABSTRACT

A photoreceptor having a photoconductive layer, an electrically insulating layer, an electrically conductive layer, and a color separation filter layer. The photoconductive layer comprises a charge generating material layer and a charge transporting material layer and the electrically insulating layer has a uniform electric charge thereon and is located at one side of the photoconductive layer. The electrically conductive layer is disposed at the side of the photoconductive layer opposite to that on which the electrically insulating layer is located. The color separation filter layer has a plurality of different kinds of color separation filters which are arranged close to one another and the layer is disposed at one side of the photoconductive layer whereby the photoconductive layer is imagewise exposed through the color the separation filters.

44 Claims, 11 Drawing Sheets

FIG. 15-[1]
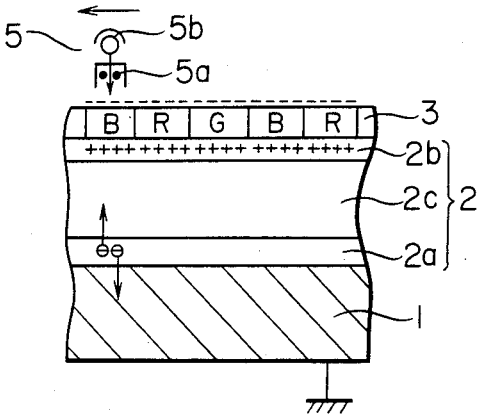
FIG. 15-[2]
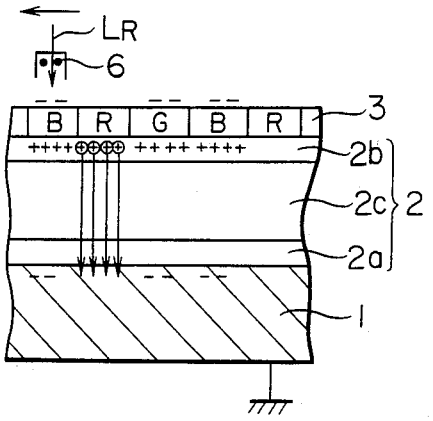
FIG. 15-[3]
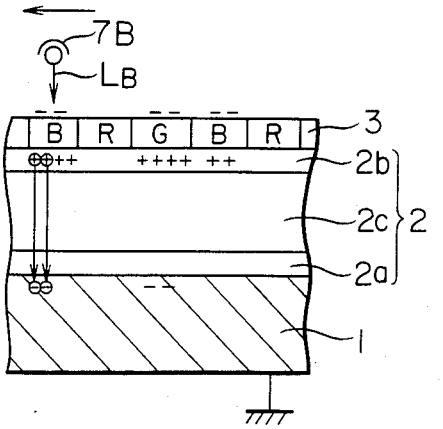

FIG. 16-[1]
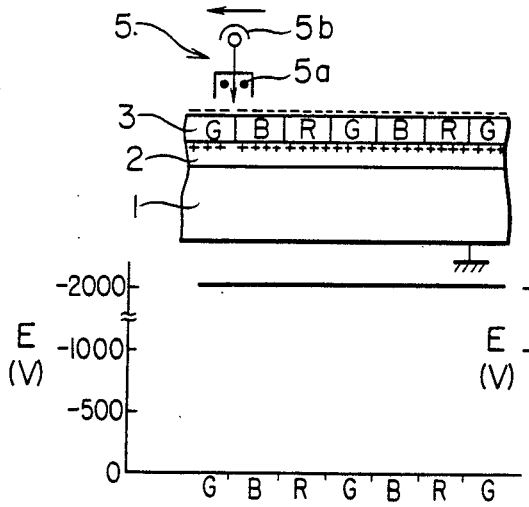
FIG. 16-[2]
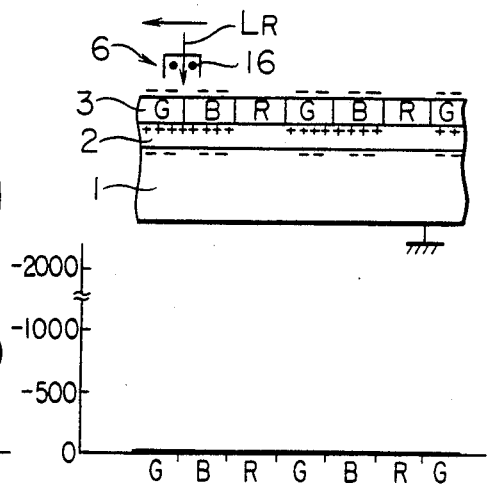
FIG. 16-[3]
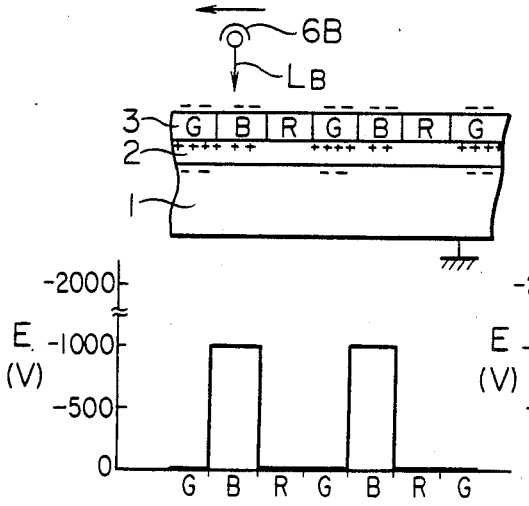
FIG. 16-[4]
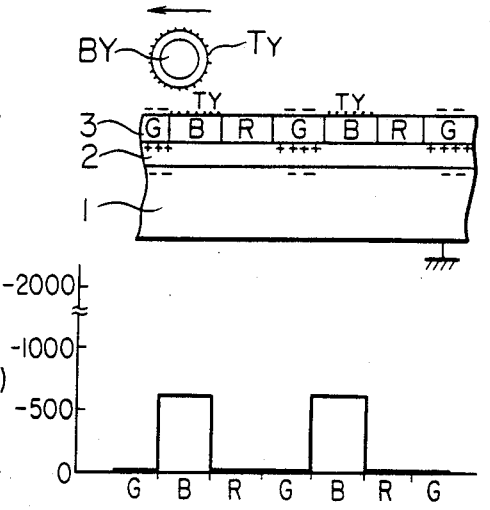

FIG. 16-[5]
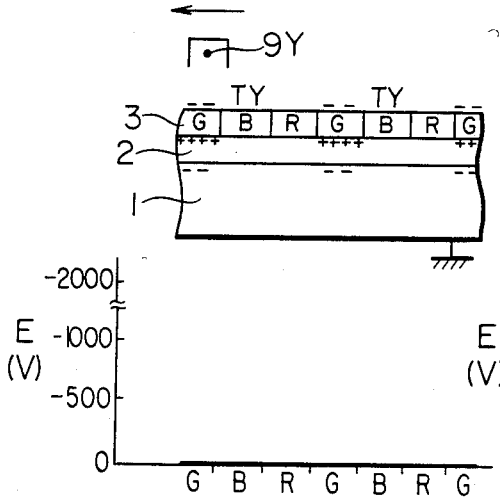
FIG.16-[6]
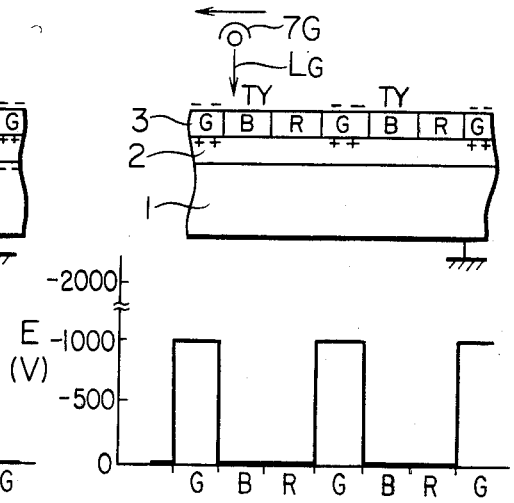
FIG.16-[7]
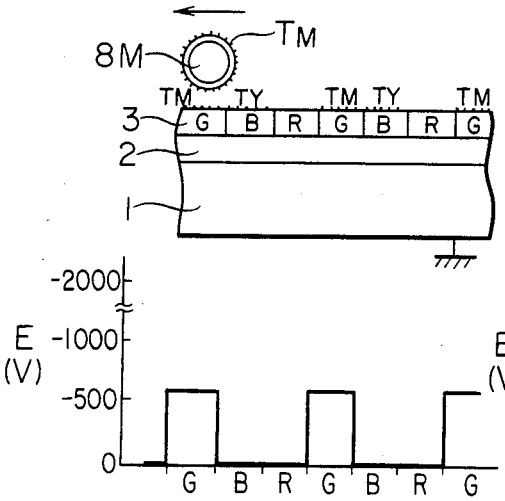
FIG. 16-[8]
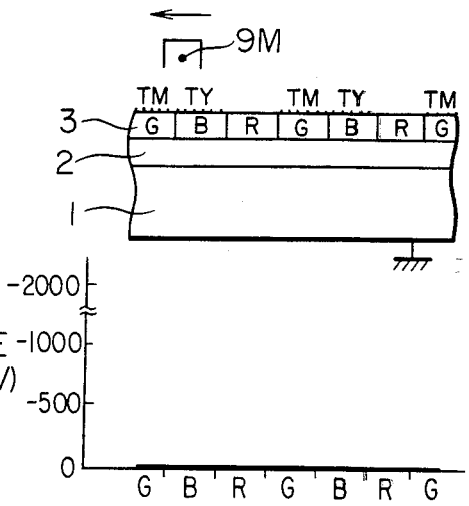

PHOTORECEPTOR FOR ELECTROPHOTOGRAPHY AND AN IMAGE-FORMING PROCESS BY THE USE THEREOF USING COLOR SEPARATION FILTER

FIELD OF THE INVENTION

The present invention relates to a photoreceptor for electrophotography and a method for forming an image, and particularly to a photoreceptor and a method for forming an image suitable for forming a multi-colored image by use of an electrophotographic process.

BACKGROUND OF THE INVENTION

Hitherto, many systems and a large number of apparatuses for use therein have been proposed with the purpose of obtaining multi-colored images by use of an electrophotographic process. But, in general, they can be roughly classified as follows. One of them is a method of repeating latent image formation and development on a photoreceptor by use of color toners in correspondence to the number of different colors to duplicate the colors on the photoreceptor, or carrying out transfer on a transfer material in each development to effect color duplication on the transfer material. In another system, an equipment having plural number of photoreceptors corresponding to the number of different colors is used to expose optical images of respective colors simultaneously on respective photoreceptors, developing the latent images formed on respective photoreceptors with color toners and effecting transfer successively to duplicate colors for obtaining multi-colored images.

In the former system, plural times of latent image formation and developing processes must be repeated, requiring time for picture image recording, so that there is such a large defect that it is extremely difficult to carry out such processes at high speed. Also, in the case of the one in which toner images are superimposed on the photoreceptor, since the potential lowering at the part adhered with previously developed toner is likely to be insufficient, the toner which is developed subsequently adheres to a part adhered with previously developed toner which is primarily no to adhere thereon to cause color turbidity.

In the latter system, there is such an advantage that the system has high speed due to the parallel use of a plural number of photoreceptors, but the equipment becomes complicated and too large, since it requires to have a plural number of photoreceptors, optical systems, and developing means, to result in becoming highly expensive and lacking practical applicability.

Further, in both systems, there is such a large defect that the positional agreement of picture images is difficult in the case of repeating picture image formation and transfer for a plural number of times, hence, color slippage of the picture image cannot be prevented completely.

In order to solve these problems fundamentally, it is considered to be appropriate that a multi-colored image is recorded on a single photoreceptor by effecting only one picture image exposure. However, in the actual situation, such a system has not yet been developed.

SUMMARY OF THE INVENTION

The present invention has been developed in view of such a situation as described above, and aims at the provision of a photoreceptor and a method of picture image formation in which a plural number of color-separated latent images can be formed by only one image exposure and consequently no color slippage is formed, and also, the subsequently developed toner does not adhere on the toner adhered part previously developed, and thus, high quality multi-colored picture images can be formed by a high speed and simple process.

The present invention relates to a photoreceptor in which a layer having plural number of kinds of color-separation filter portion and a photoconductive layer are equipped on an electrically conductive support and said photoconductive layer comprises a layer containing a charge-generating substance and a layer containing a charge transfer substance.

Also, the present invention relates to a method for forming picture images in which image exposure is carried out from the side of the layer having a plural number of kinds of color-separation filter portion onto the photoreceptor, and subsequently, a uniform exposure is effected with a specified light to form a potential pattern on the parts corresponding to the said color-separation filter to repeat the developing process to form picture images, and in which said photoconductive layer comprises a layer containing a charge-generating substance and a layer containing a charge transfer substance.

The present invention relates, according to the most preferable embodiment of the invention, to a photoreceptor which is characterised in that the photoreceptor is constituted of an insulating layer having plural kinds of color-separation filter parts and a photoconductive layer, said photoconductive layer comprising a layer containing charge generating substances and a layer containing charge transporting substances, and in that the relation between the film thickness $d_1$ ($\mu$m) of the above described insulating layer and the film thickness $d_2$ ($\mu$m) of the photoconductive layer is $0.25 \leqq d_1/d_2 \leqq 2$.

Further, the present invention relates to a method for forming a picture image in which image exposure is effected to a photoreceptor from the side of a layer having a plural number of color-separation filter portion, and subsequently, whole surface exposure with a specified light is applied to form a potential pattern on the parts corresponding to the above-described color-separation filter and then the processes for effecting development are applied. In the method is used a photoreceptor in which the relationship between the thickness $d_1$ ($\mu$m) of the above-described insulating layer and the thickness $d_2$ ($\mu$m) of the photoconductive layer is $0.25 \leqq d_1/d_2 \leqq 2$.

BRIEF DESCRIPTION OF THE DRAWINGS

All the drawings show the embodiments of the present invention, respectively.

FIG. 15(1) to 15(3) and FIGS. 16(1) to 16(8) are process flow charts for showing the picture image formation process;

Further, the marks shown in the figures denote, respectively, the following ones:

1: Conductive substrate,
1–2: Transparent conductive layer,
2: Photoconductive layer,
2a: First charge generating layer,
2b: Charge transporting layer,
2c: Second charge generating layer,
2d: Layer containing a charge generating material and a charge transporting material,
2g: Charge generating material,
2t: Charge transporting material,
3: Insulating layer,
3a: Layer consisting of color-separation filters

DETAILED DESCRIPTION OF THE INVENTION

In the following, the present invention will be explained by referring to examples shown in figures.

Although the examples shown in figures all show the examples in which 3 kinds of filters, red, green and blue, which transmit red light, green light and blue light, respectively, are used as color-separating filters (filters for transmitting light of specified wave length ranges) and 3 kinds of color toners corresponding thereto, the present invention is not limited to such number of kinds of color combination.

Figure 1:
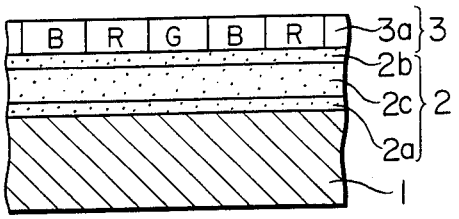
FIGS. 1, 2, 3, 4, 5, 6, 7, 8, 9, 10, 20 and 21 are sectional views of a photoreceptor.
Figure 2:
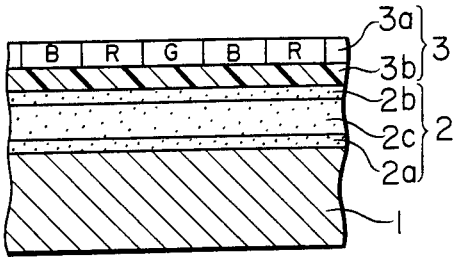
Figure 3:
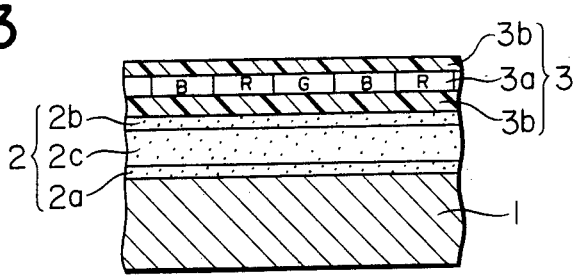
Figure 4:
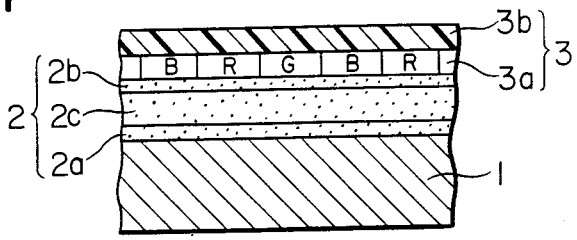
Figure 5:
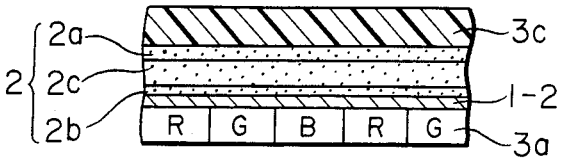
Figure 6:
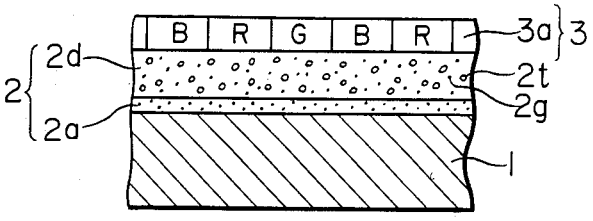
Figure 7:
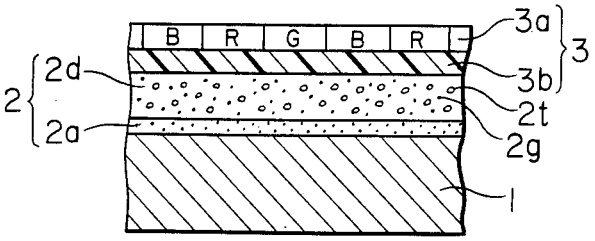
Figure 8:
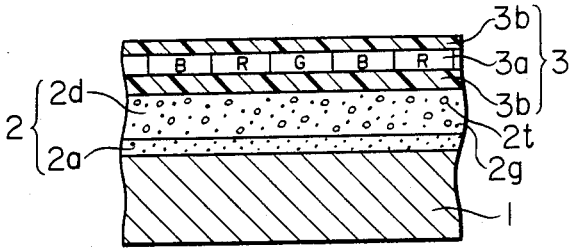
Figure 9:
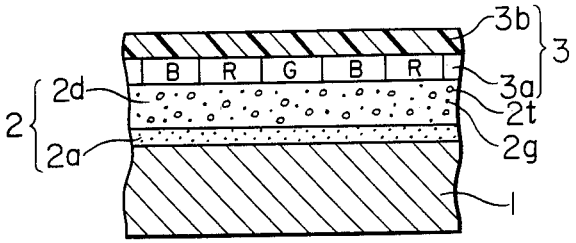

In FIGS. 1 to 10, numeral 1 is a conductive substrate or support formed in an appropriate shape and construction such as cylinder-like, endless belt-like, or in sheet-form, etc. by use of a metal such as aluminium, iron, nickel, copper, or the like, or by use of alloys thereof, conductive films or the like, and numeral 1–2 denotes a transparent conductive layer formed by vapor depositing these metals or alloys. Numeral 2 denotes a photoconductive layer (details will be described later), and numeral 3 an insulating layer including a layer 3a in which color-separation filters such as red(R), green(G), or blue(B) formed with coloring agents such as pigments, dyes or the like and various kinds of polymers, resins, or the like. The insulating layers 3 in the photoreceptors of FIGS. 1 and 6 are formed by adhering insulating substances such as a resin or the like colored by adding a coloring agent for forming a color-separation filters on a photoconductive layer 2 in a predetermined pattern by use of a means such as printing or the like. The insulating layers 3 in the photoreceptors of FIGS. 2 and 7 are formed by previously forming a transparent insulating layer 3b on a photoconductive layer 2 by a hitherto known means, and subsequently adhering coloring agents, colored resins, or the like on the surface thereof in a predetermined pattern by use of a means such as printing, photoetching, vapor deposition or the like. The insulating layers 3 in the photoreceptors of FIGS. 3 and 8 are respectively formed by further providing a transparent insulating layer 3b on the insulating layers 3 of FIGS. 2 and 7 by a means hitherto known. The insulating layers 3 in the photoreceptors of FIGS. 4 and 9 are formed by providing a transparent insulating layer 3b on the substrate made by making a coloring agent adhere on a photoconductive layer 2 by use of a means such as direct printing, photoetching, vapor depositing, or the like in a predetermined pattern, or on the insulating layers 3 of FIGS. 1 and 6, in a similar manner as in the insulating layers 3 of FIGS. 3 and 8. The formation of insulating layer 3 is not limited to the ones shown in the above-described examples, and the one may also be used, which is made by previously forming an insulating film or a sheet containing a distribution layer 3a of color-separation filters and the product is attached or adhered on the photoconductive layer 3 by means of an appropriate means.

Figure 20:
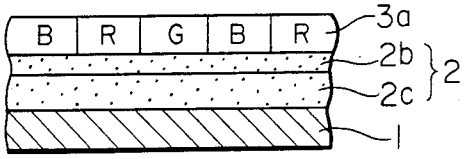
Figure 21:
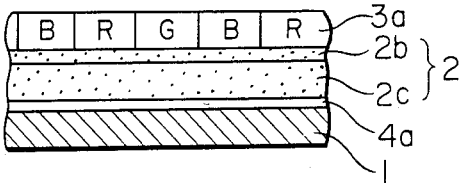

Also, the photoreceptor can be made to have such a structure as that in which the charge generating layer 2a in a photoconductive layer 2 is omitted in comparison to that shown in FIG. 1, to become such as, for example, is shown in FIG. 20. In this case, in order to let the charge pour into the interface between the insulating layer and the photosensitive layer, construction materials are selected in such a way that the charge pours from the conductive substrate 1 into the layer 2c containing charge transporting materials. As shown in FIG. 5, other than the structure selected to be capable of direct pouring from the conductive substrate 1, a structure is shown in FIG. 21 in which it is selected to enable pouring by providing a charge pouring layer 4a.

Figure 10:
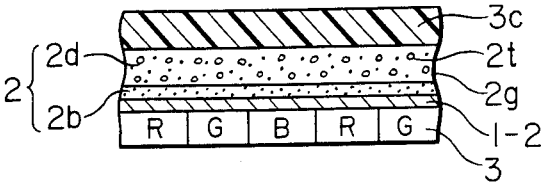

Also, the photoreceptor can be made to have such a structure as that which was previously proposed by the present applicant (Japanese patent application No. 199547/84). For example, as shown in FIGS. 5 and 10, a transparent insulating layer 3c is provided on one surface of the photoconductive layer 2 and a light transmissive layer 1–2 and an insulating layer 3a consisting of color-separation filters are successively provided on the other surface to form a laminated structure. The light transmissive conductive layer 1–2 is made, for example, by vapor depositing a metal. In the photoreceptor having such a construction as described above, electric charging which will be described later is carried out from the side of the insulating layer 3c, and the image exposure and whole surface exposure are effected from the side of the insulating layer 3a consisting of color-separation filters.

Figure 11:
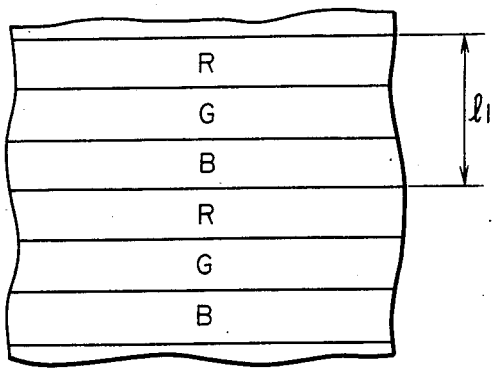
FIGS. 11, 12, and 13 are plan views of a color-separation filter.
Figure 12:
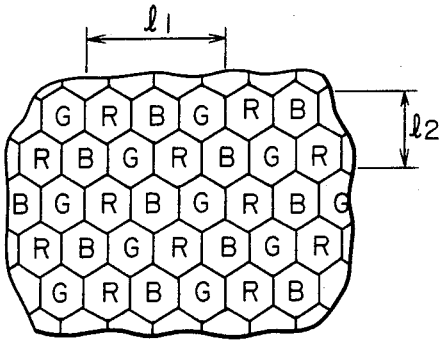
Figure 13:
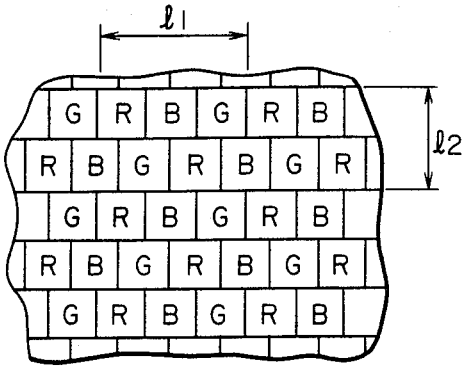

The color-separation filter layer 3a in an insulating layer 3 is not particularly limited in its shape and arrangement of fine filters such as R, G, B, etc., but in view of the simplicity of pattern formation, the one with the stripe-like distribution as shown in FIG. 11 is preferable, and the ones with the mosaic-like distribution as shown in FIGS. 12 and 13 are also preferable in view of the reproduction of fine multi-colored picture images. The direction of arrangement of filters such as R, G, B, etc. may be oriented to any direction of the extending direction of the photoreceptor, namely, of course, the one with the mosaic-like distribution may be adopted, but also the one with the stripe-like distribution may be used. That is, in case, when the photoreceptor is a rotating drum-like photoreceptor, the length-wise direction of the stripes may be selected to be parallel, oblique, or spiral-like. The kind of filters is also not limitted to the 3 kinds of R, G, B, but 3 kinds of other colors such as, for example, Y (yellow), M (magenta), and C (cyan) may also be used. In case when use is made for not full colors but for two colors only, color-separation filters distributed with white color light transmissive parts and specified color light (for example, red) transmissive parts may be used. When the individual size of the filters such as R (red), G (green), and B (blue), etc. becomes too large, the resolving power and the color mixing properties lower to deteriorate the quality of the picture image, and when the size becomes too small to become in the same order or not more than the particle diameter of the toner particle, the influences from adjacent other color parts are liable to become evident and the formation of the distribution pattern of filters becomes difficult. Therefore, in case of the distribution of 3 kinds of filters as shown in the example in the figure, it is preferable that the length of one cycle $1_1$ or $1_2$ of the repeating cycle becomes in the order or size of 10 to 500 μm, or preferably 30 to 300 μm. When the number of kinds of filters alters, it is, of course, noted that the above-described preferable range of the length $1_1$, $1_2$ also varies.

The thickness of the insulating layer containing the filtering layer is 5 to 60 μm, or particularly preferably 10 to 40 μm.

Further, it is desirable that respective filters have high resistance, particularly not less than $10_{13}$ Ω.cm. When they have low resistance, a gap or intervening insulaters may be provided to electrically insulate each other. The insulating layer thus formed has desirably a resistance value not less than $10^{13}$ Ω.cm. By the way, in case when the photoreceptor has the structure as shown in FIGS. 5 and 10, filters may have low resistance.

One of the features of the photoreceptor according to the present invention resides in the structure of the photoconductive layer.

As a photoconductive layer, a layer consisting of a single layer is widely used, but a photoconductive layer consisting of a single layer has the following problems:

(i) In case when injection of charge is effected from a conductive substrate, the selection of the materials for the substrate and the photoconductive layer is subjected to restriction. For example, an aluminium substrate is not preferable to be used for a selenium photoconductive layer, and a nickel substrate is preferred.

(ii) In the formation of multi-colored picture images, the one having panchromatic spectral sensitivity distribution is desired, but such a photoconductive layer has generally low charge retention ability and large dark attenuation.

In view of such a fact, a photoconductive layer used in the present invention comprises two layers i.e. a layer containing a charge generating material (charge generating layer (CGL)) and a layer containing charge transporting material (charge transporting layer (CTL)), or a photoconductive layer is used, which has a layer containing both the charge generating material (CGM) and the charge transporting material (CTM) (in the following, the layer is called as (CGM+CTM)). The photoreceptor constructed as described above has such an advantage that it is easy obtain a photoreceptor which has panchromatic sensitivity in accord with the light source and filters, and moreover, its charge retention ability is normally good.

However, in the picture image forming method according to the present invention, when a photoreceptor laminated in such an order as a conductive substrate, CGL, CTL, and an insulating layer having mosaic filters is used, charge is generated in CGL by charging and uniform exposure (for example, uniform exposure with white light), and the charge is displaced through the CTL layer to be accumulated in the interface between the insulating layer and the photoconductive layer. However, the charge generated in CGL by the image exposure under the next charging in the reverse polarity and to be displaced to the side of the insulating layer is in reverse polarity in contrast to the charge generated in the previous process, so that the former charge can not be displaced in CTL (there are general electron displacement type and positive hole displacement type, and only either of the two charges i.e. electron or positive hole can be mobile), and due to such a fact, no photosensitivity can be obtained.

As a result of study of the present inventors, success of development has been obtained, in which the photoconductive layer is constructed to let the advantages of the above-described photoconductive layer, wherein both functions of charge generation and charge displacement have been allotted, survive as they are, and thus to be enabled to obtain a photoreceptor and a method for forming picture images which are capable of being used in multi-colored picture image formation.

The structure of the photoreceptor according to the present invention will be exemplified in FIGS. 1 to 10, 20 and 21. The structures thereof can be classified into two kinds.

One of the structures is shown in FIGS. 1 to 4, wherein the first CGL *2a*, CTL *2c*, and the second CGL *2b* are successively laminated on a conductive substrate 1, and a photoconductive layer is formed thereby; or in the same manner as in FIG. 5, the second CGL *2b*, CTL *2c*, and the first CGL *2a* are successively laminated to construct a photoconductive layer 2 thereby.

Another one of the construction is shown in FIGS. 6 to 9, wherein the CGL *2a* (the same one as the above-described first CGL) and the (CGM+CTM) layer *2d* are successively laminated to form a photoconductive layer 2, or as shown in FIG. 10, the CGL *2b* similar to the above-described second CGL, and the (CGM+CTM) layer *2d* are successively laminated on the light transmissive conductive layer 1-2 to construct a photoconductive layer 2.

In a preferable embodiment of the present invention, charge is generated at the time of image exposure in the CGL *2b* or in the (CGM+CTM) layer *2d*, and at the time of charge injection previous to the image exposure, charge is generated in the CGL *2a* or in the (CGM+CTM) layer *2d* which are positioned in the reverse side of the image exposure light irradiation side.

The reason is as follows:

In case when charge is intended to be generated at the time of image exposure in the CGM *2a* (in FIG. 10, the (CGM+ CTM) layer *2c*) which is at the reverse side to the image exposure light irradiation side, the image exposure light is absorbed into the CGM *2b* which is in the front thereof to cause large extent lowering of light sensitivity and change of spectral sensitivity, to become difficult to obtain a good quality picture image. As described previously, by making charge be generated in the layer in the image exposure light irradiation side, the absorption of the image exposure light in the midst of the way becomes to be in an almost negligible extent and the charge generation is sufficiently effected. Also, in the time of charge injection previous to the image exposure, even if the uniform exposure light is partly absorbed into the second CGL *2b*, as this uniform exposure is effected to let the charge be injected, little maleffect is given to the picture image obtained. In order to let the uniform exposure light be effectively utilized, it is still more desirable for the photoreceptor to be designed in such a manner that the charge generation by these layers has a wider or different spectral sensitivity distribution (for example, has sensitivity in a long wave-length range) than the first CGL 2*a* or the (CGM+CTM) layer 2*d*.

When the charge generating layers 2*a* and 2*b* are too thick, satisfactory optical sensitivity can not be obtained, and their thickness is in either case suitable to be in the range of 0.001 to 10 μm, and they can be formed by the vapor deposition method, coating method, or the like.

The layer containing charge generating material 2*g* and charge transporting material 2*f*, that is, the (CGM+CTM) layer 2*d* can be prepared as follows:

The amount of the charge generating material (CGM) 2*g* is required to be satisfactory to let the charge be sufficiently generated. The mixing amount thereof is to be selected as about 0.05 to 50% by weight in the (CGM+CTM) layer 2*d*.

Further, the charge generating layers 2*a* and 2*b* are preferably made so as to let the transprot of the generated charge be sufficiently effected. In order to realise such a purpose, it is better to let the above-described (CGM +CTM) layer 2*g* be prepared with the charge generating matreial 2*g*, the charge transporting material 2*f* (these materials will be described in detail later), and a resin as a binder. The amount of the charge generating material 2*g* is preferable to be made so much as to be about 30 to 95% by weight.

Next, explanation will be given on the materials of respective layers used in the construction of the photoreceptor.

As materials for the conductive substrate 1, can be used metal substrate, for example, such as those made of nickel, brass, aluminum, etc., but vapor deposited layers consisting of paper or plastic film vapor deposited with a metal or the like may be also used.

As the materials for the charge generating material 2*g* in the first charge generating layer 2*a*, the second charge generating layer 2*c*, and the (CGM+CTM) layer 2*d*, can be used metals such as Se, Se-Te, Se-Te-As, etc.; inorganic compounds such as CdS, ZnS, CaSe, ZnO, etc. and organic compounds such as given hereinafter may be mentioned:

(1) Phthalocyanine dyes such as metal phthalocyanine, and metalfree phthalocyanine

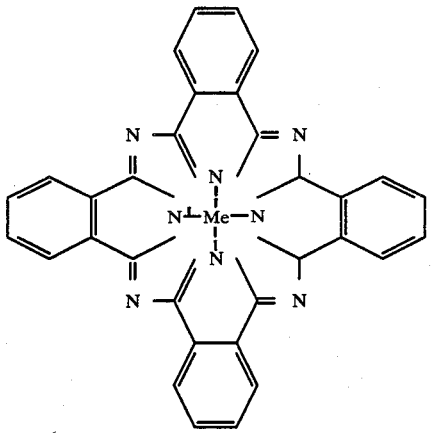

Where Me denotes a metal such as Cu or the like.

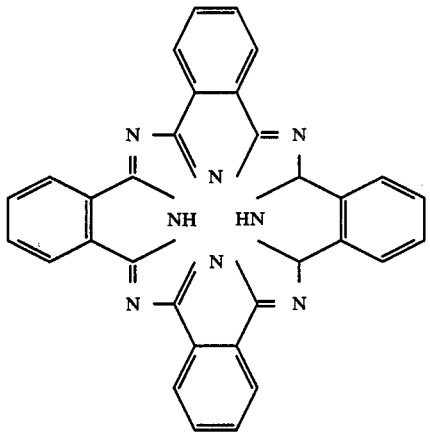

(2) Azo dyes such as mono-azo dyes and di-azo dyes

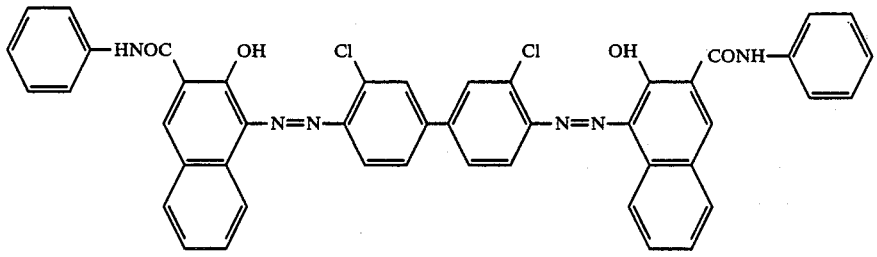

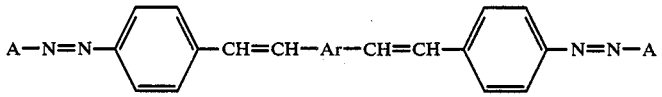

-continued
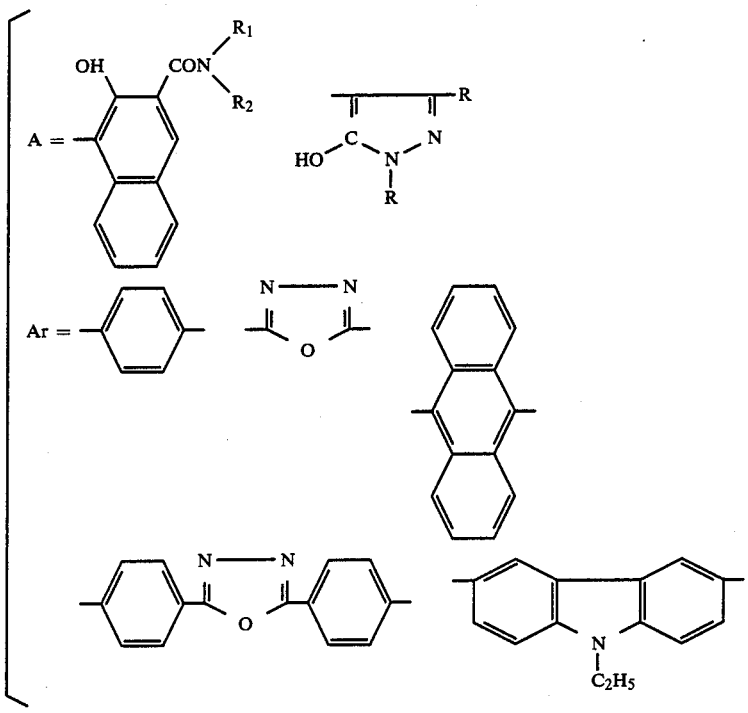
A—N=N—Ar—N=N—A
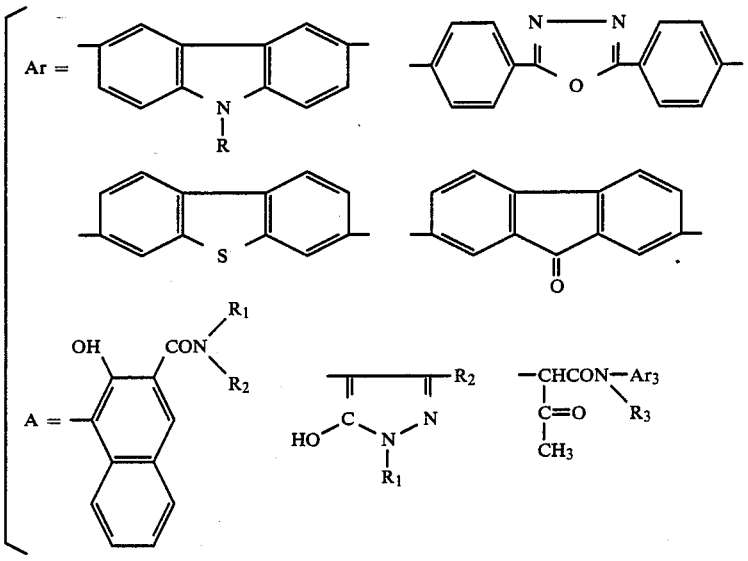
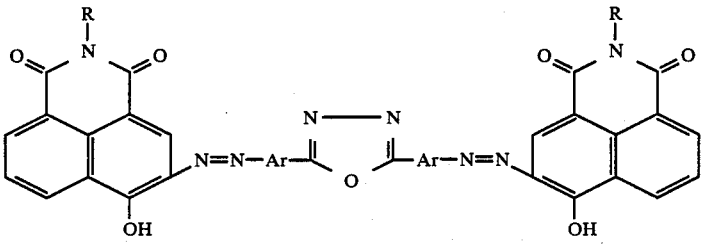
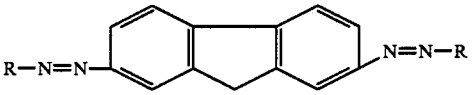

-continued
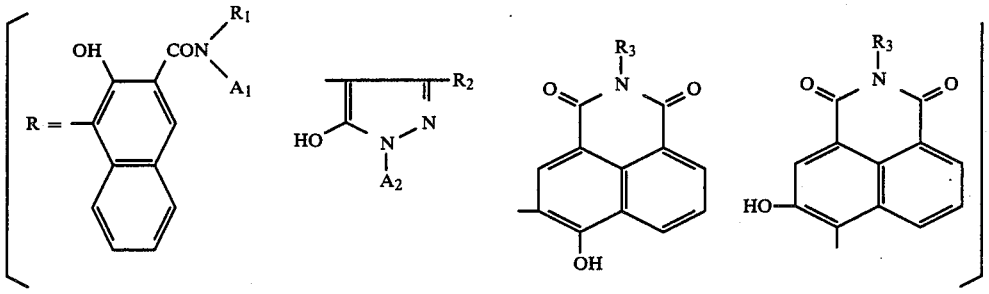
(3) Perillene dydes such as perillenic acid anhydride, perillenic acid imide, etc.
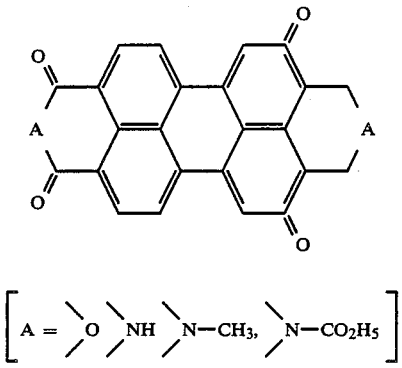
(4) Indigo and thioindigo system indigoid dyes
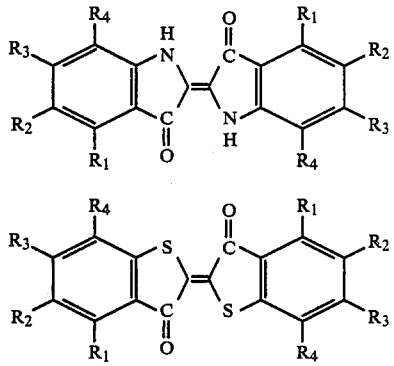
(5) Polycyclic quinone dyes such as anthoanthrone, dibenzpyrene quinone, biranthrone, bioranthrone, isobiocinthrone, etc.
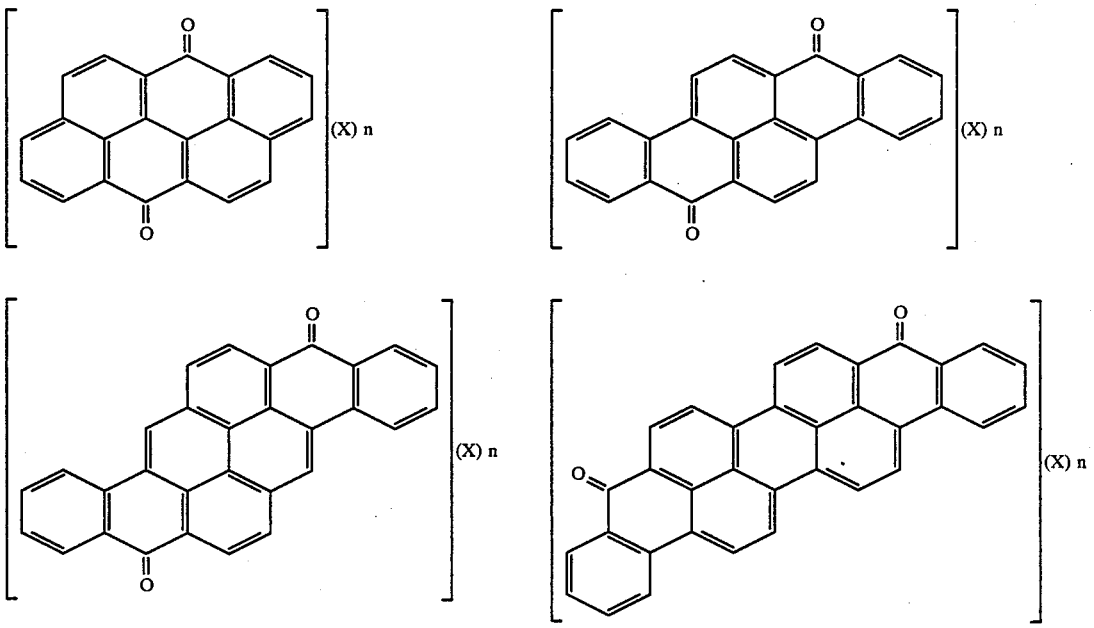

-continued

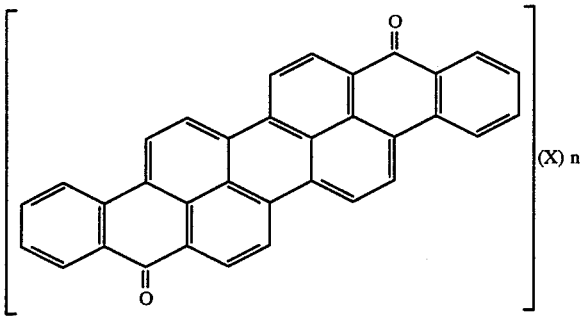

wherein X denotes a halogen atom (6) Anthraquinone dyes

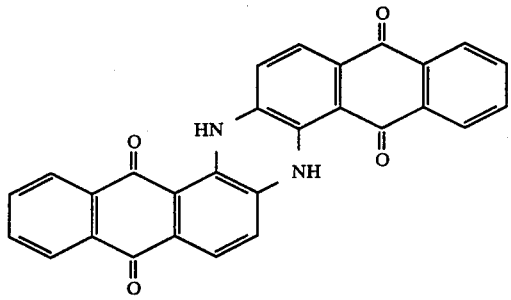

(7) Quinacridone dyes

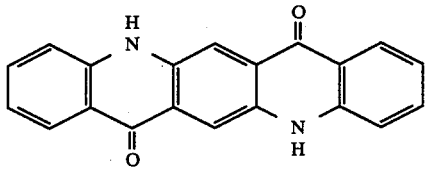

(8) Cyanin dyes

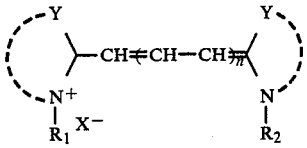

(9) Benzimidazole dyes

(10) Dioxan dyes

The charge generating layer comprising inorganic or organic charge generating material can be prepared by means of vapor deposition, or by coating a solution in which the above-described charge generating material, a binder resin, and optionally a substance having a large mobility for an electric charge of specified or non-specified polarity, that is, a charge transporting material (details will be described later) are incorporated. The thickness of the charge generating layer is suitably selected as 0.001 to 10 μm, or particularly suitably as 0.05 to 5 μm.

As the above-described binder resins, can be cited addition polymerization type resins, double addition type polymerization resins, double bonding type polymerization resins such as, for example, polyethylene, polypropylene, acrylic resin, methacrylic resin, vinyl chloride resin, vinyl acetate resin, epoxy resin, polyurethane resin, phenolic resin, poly ester resin, alkyd resin, polycarbonate resin, etc. and copolymer resins containing two or more of the repeating units of these resins such as, for example, vinyl chloride vinyl acetate copolymer resin, vinyl chloride-anhydrous maleic acid copolymer resin, etc. However, the binder resin is not limitted to these resins, and resins which are generally known for the relevant art may also be used.

The above-described charge generating material contained in the second charge generating layer 2a may be anyone which absorbs the light of the whole visible range and generates free charge, taking the color reproducibility into consideration. It is advantageous that the spectral sensitivity of the first charge generating layer 2a is made broader than that of the second charge generating layer 2b in the side of the insulating layer 3, or the distribution thereof is shifted. That is, since the second charge generating layer 2b generates electric charge by means of image exposure, it is desirable that it has spectral sensitivity in a visible range. Hence, in the first charge generating layer 2a, electric charge being generated with the whole surface exposure light, it is desirable to have spectral sensitivity in the range where the light is not absorbed in the second charge generating layer 2b . It is also desirable for the first charge generating layer to have spectral sensitivity in addition to the light in the visible range, light in the infrared and/or ultraviolet ranges. By making the spectral sensitivity of the respective CGL's such as described above, it is possible to make the effect of the absorption of the whole surface exposure light by the second charge generating layer small.

The above-described relation of the spectral sensitivity between the first charge generating layer 2a and the second charge generating layer 2b can be applied between the charge generating layer 2a and the (CGM+CTM) layer 2d.

The charge transporting layer 2c has a function of transporting either one of the positive or negative charge generated by absorbing light in the previously described charge generating layers 2a and 2b, that is, the main matter is a charge transporting material. The charge transporting layer 2c comprises at least one charge transporting material, and in addition it can optionally contain a binder resin, Lewis acid and/or Bronsted acid and the like. For example, these are dissolved together in a solvent, and this solution is coated and dried on the first charge generating layer 2a to enable the formation of charge transporting layer 2c.

The preferable mixing ratio of respective components in the charge transporting layer 2c is in the range of 0 to 400 parts by weight, and more preferably 100 to 200 parts by weight of the binder resin to 100 parts by weight of the charge transporting material. The thickness of the charge transporting layer 2c is 10 to 100 μm, and particularly preferably 20 to 50 μm.

As the charge transporting material in the charge transporting layer 2c and the charge transporting material 2f in the (CGM+CTM) layer 2d can be used various substances, and examples thereof can be shown as follows:

(1) Aryl alkane compounds (P-type)

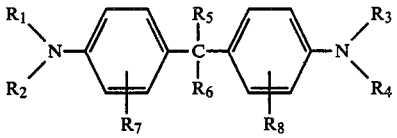

(general formula)

For example,

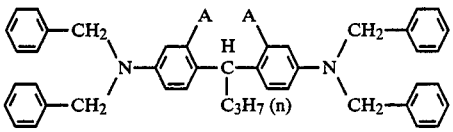

A is $=CH_3$ or $-OCH_3$ (2) Pyrazoline compounds (P-Type)

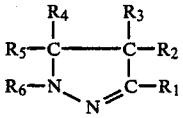

(general formula)

For example,

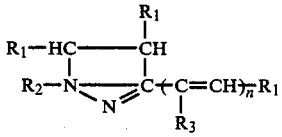

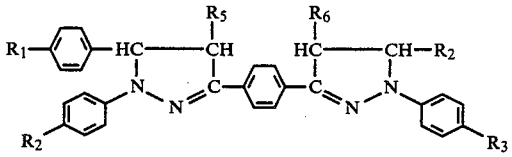

(3) Oxadiazole compounds (P-type)

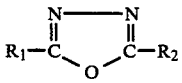

(general formula)

For example,

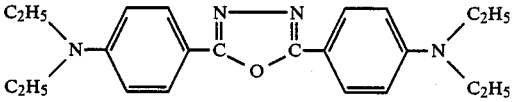

(4) Hydrazone compounds (P-type)

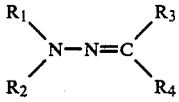

(general formula)

For example,

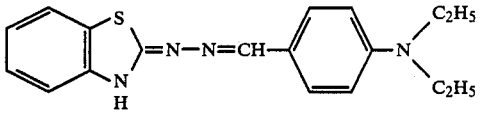

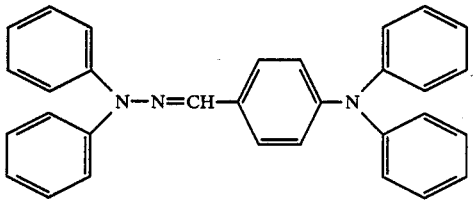

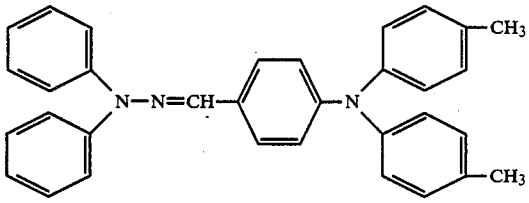

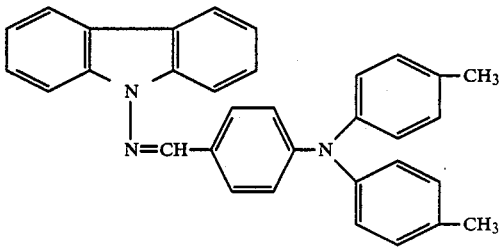

(5) Styril compounds (P-type)

$R_1\text{-}(CH=CH)_n\text{-}Ar$ (general formula)

$R_1 =$

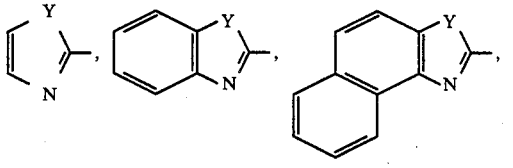

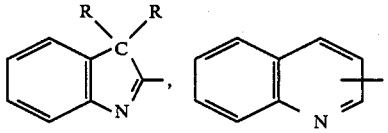

Y=O, S

R=alkyl

Ar is a substituted or unsubstituted phenyl

For example,

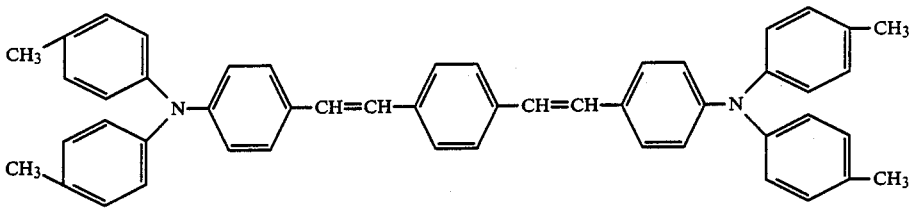
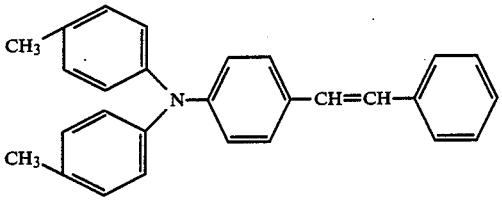
(6) Triphenyl amine compounds (P-type)
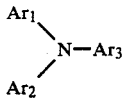
(general formula)
For example,
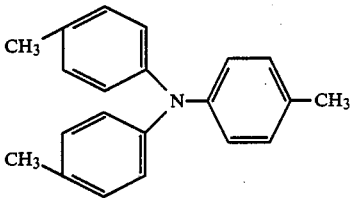
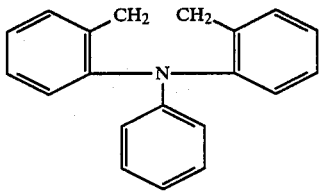
(7) Phenylene diamine substances (P-type)
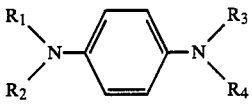
(general formula)
(8) Biphenyl amine substances (P-type)
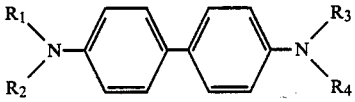
(general formula)
For example,
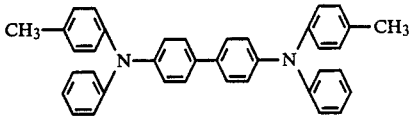
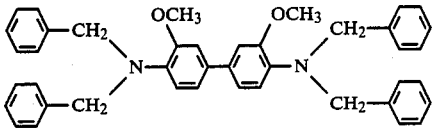
(9) Carbazole substances (P-type)
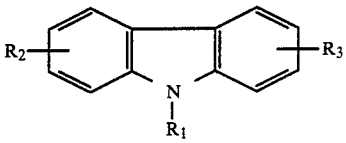
(general formula)
For example,
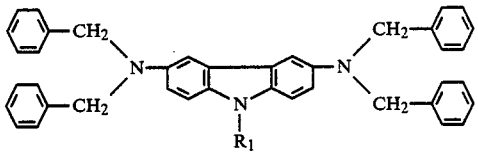
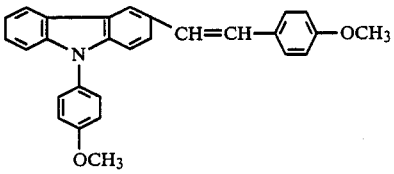
(10) Fluorenon derivatives (N-type) such as trinitrofluorenon (TNF)

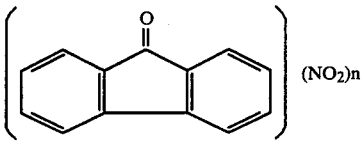

These charge transporting material can be contained in the charge generating layers 2a and 2b. Also, as the binder resin, can be used the ones contained in the charge generating layers 2a and 2b.

Further, for the charge injection layer in the photoreceptor of the present invention, are used metallic selenium, copper oxide, nickel, gold, tellurium, conductive carbon, tin oxide, indium oxide, etc. Especially, for positive hole injection, metallic selenium, copper oxide, gold, nickel, tellurium, and conductive carbon are preferable.

In the present invention, particularly in the case where the charge injection layer is a low resistance material capable of injecting charge, it can be used in combination with the conductive substrate.

The above-described charge injection materials may be provided on a conductive sheet or a belt by being mixed with an adhesive, or by laminating by vapor deposition, sputtering, etc. In the photoreceptor having the construction described above, the thickness of the insulating layer is 5 to 50 μm, or preferably 10 to 40 μm, and the thickness of the photoconductive layer is 10 to 100 μm, or preferably 15 to 50 μm.

Figure 14:
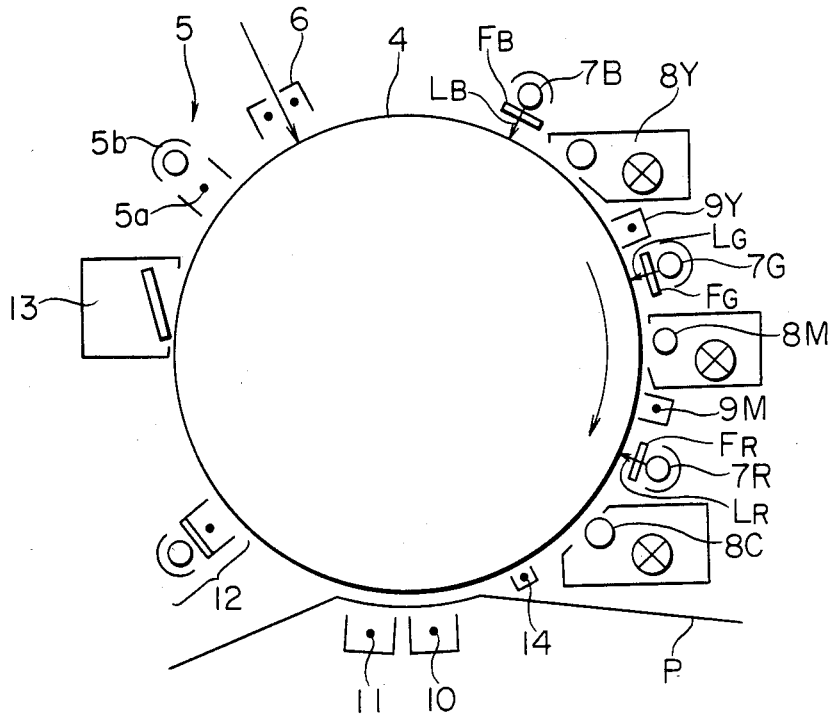
FIG. 14 is a schematic view of an image-forming equipment.

The picture image forming equipment shown in FIG. 14 forms a multi-colored picture image according to the present invention by use of a drum-like image carrying member 4 comprising such photoreceptors as described above. That is, the image carrying member 4 rotates in the direction of the arrow to let the surface thereof be subjected to uniform exposure and the charger 5 be charged to uniform potential. On the charged surface thereof image exposure is effected by making the reflected light or transmitted light caused when the image exposure equipment 6 scanned a manuscript with a white light impinge through a slit of the charger, while giving charge with alternating current or with a charge which effects corona discharge of opposed polarity to the charger 5. Then, blue colored light Lb sent from the color exposure equipment 7B through a blue filter Fb is made uniformly impinged, and thereby is formed a static latent image which gives a blue complementary image on the previously described image exposure surface. The static latent image is developed by the developing equipment 8Y which uses yellow toner as a developer. Then, discharge is effected from a charger 9Y, which carries out corona discharge similar to the one of the chargers of the image exposure equipment 6 to the iamge carrying member 4 after development to smooth out the potential of the image carrying member 4. On the potential smooth surface is uniformly injected a green light LG which has been made passed through a green filter FG by the color exposure equipment 7G to form an electrostatic latent image for giving a green complementary color image. The electrostatic latent image is developed with the developing equipment 8M which uses magenta toner as a developer. The image carrying member after the development is treated by effecting corona discharge with a charger 9M similar to the charger 9Y to smooth out the potential of the image carrying member 4. The smoothed surface is injected uniformly with a red light which has been passed through a red filter FR with a color exposure equipment 7R to form an electrostatic latent image giving a red colored complementary image. The electrostatic latent image is developed with a developing equipment which uses a cyau toner as a developer. By means of such processes as described above, a multi-colored image formed by the superimposition of 3-colored (yellow, magenta, and cyan) toner images can be obtained. The multi-colored image is transferred on a recording paper P fed from a paper supply apparatus (not shown) by a transfer device 10. The transcribed recording paper is separated with a separator 11 from the surface of the image carrying member 4, and fixed with a multi-colored image by a fixing device not shown and delivered out of the device. The surface of the image carrying member 4 from which a multi-colored image is transferred is treated to remove electricity, and the residual toner is removed with a cleaning device 13 to be returned again to a stage where the next multi-colored image formation can be applied.

Respective processes of the method of forming multi-colored picture images according to the present invention carried out with the equipment shown in FIG. 14 will be explained further by referring to FIGS. 15 and 16. In FIGS. 15 and 16, examples are shown in which the photoreceptor with the structure shown in FIG. 1 is used as the image carrying member 4, and in the charge transporting layer 2c constituting the photoconductive layer 2 materials having positive hole mobility are used. In FIGS. 15 and 16 also, the same symboles as in FIG. 1 and FIGS. 11 to 13 denote members having the same functions, respectively. Further, even in the case that the photoreceptors having the structure as shown in FIGS. 2 to 10, respectively, there is no difference in principle.

FIG. 15 is a diagram for explaining the generation and transfer of charge in the processes from charge injection to the whole surface exposure of specified light.

As shown in FIG. 15(1), when uniform exposure is effected with white light or infrared light, etc. from the light source 5b simultaneously with the negative discharge by the charger 5a of the first charging device 5, negative charge is accumulated on the surface of the insulating layer 3, and together with that, positive and negative charge are generated on the first CGL 2a by the uniform exposure of light, and this positive charge moves through the CTL 2c to the second CGL 2b, simultaneously, the negative charge generated in the first CGL 2a escapes to the earthed circuit through the conductive substrate 1 to be eliminated.

Next, as shown in FIG. 15(2), when image exposure is effected while effecting corona discharge of positive or alternate current by the secondary charger 6, explanation can be given by citing the case as an example, where a red light LR has been irradiated, the negative charge on the surface of the insulating layer 3 partly vanishes in the part except the R filter part. In the R filter part, since red-colored light LR transmits the R filter part and irradiates the second CGL 2b, positive and negative charges are generated, and the negative charge neutralizes the trapped positive charge. On the other hand, the generated positive charge passes through the CTL 2c, the first CGL 2a, and the conductive substrate 1 to escape into the earthed circuit, so that the positive charge in the second CGL 2b vanishes, and together with that, the negative charge on the surface of the insulating layer 3 also substantially vanishes.

Next, as shown in FIG. 15(3), when the whole surface exposure by a blue colored light LB is effected, the part other than the B filter part is not transmitted by the blue-colored light Lb and is not changed, but in the B filter part through which the blue colored light has transmitted, a part of the positive charge in the second CGL *2b* thereunder passes through the CTL *2c* and the first CGL *2b* to neutralize the negative charge in the side of the photoconductive layer 2 of the conductive substrate 1.

FIG. 16(1) shows the state of the image carrying member 4 which has been rotated and uniformly charged in the negative by the corona charger 5. On the surface of the insulating layer 3, there is generated negative charge and in correspondence to that there is induced positive charge displaced from the first charge generating layer in the interface between the photoconductive layer 2 and the insulating layer 3. As a result, the surface of the image carrying member 4 shows uniform potential as can be seen in the graph of the potential B.

In FIG. 16, respective layers constituting the photoconductive layer 2 are omitted in the drawings.

FIG. 16(2) shows the change of the charged surface by the red color component LR among the manuscript image exposure injected on the above-described charged surface by the image exposure device 6. The red color component LR passes through the R filter part of the insulating layer 3 and generates charge in the second charge generating layer in the photoconductive layer 2 thereunder to eliminate the positive charge trapped by negative charge and, on the other hand, makes the positive hole generated in the conductive substrate displace, thereby to let the positive charge in the interface between that part and the insulating layer 3 of the photoconductive layer 2 vanish, and thus the negative charge on the surface of the insulating layer 3 also eliminated by the discharge by the charger of the image exposure device 6, and thus, the charge becomes absent (due to the purpose of explaining the principle, the part with much red color components is taken in the description). On the contrary, since the parts of G and B filters do not pass the red color component LR, negative charge of the photoconductive layer 2 remains as it is, and even discharge by the charger has been carried out, the negative charge remains due to the positive charge of the photoconductive layer 2, after the part have passed through the position of the image exposure device 6. However, in the R filter part where charge has vanished, of cource, but also in the G and B filter parts where charge remains, the surface potential of the image carrying member 4 due to positive and negative charges is balanced and nearly zero as can be seen in the graph of the potential B. Although omitted in FIG. 16, the green components and blue components also give similar results, and the summed up state thereof is the state in which image exposure has been effected by the image exposure device 6, and this state is a state where the primary image which does not function as an electrostatic image has been formed.

FIG. 16(3) shows the state in which the blue color light LB which has been passed through the blue filter FB by the blue exposure device 7B has been injected uniformly on the above-described image exposure surface. As the blue light LB does not pass through the R and G filter parts, no charge is given to these parts, but passes through the B filter part and makes the photoconductive layer thereunder conductive to thereby neutralize the charge on the up and down interfaces of the photoconductive layer at that part. As a result, there appears in the graph of potential B at the B filter part, the potential which gives the complementary color image of B formed on the insulating layer by the previous image exposure.

Up to here, the process is the same as that already explained by referring to FIG. 16.

FIG. 16(4) shows the state in which the electrostatic image formed by the whole surface exposure of the blue light LB is developed by a developing device 8Y using yellow toner TY, which is the complementary color of negatively charged B, as a developer. The yellow toner TY adheres only on the part of the filter showing potential, and does not adhere to the R and G filter parts where no potential is found. On the surface of the image carrying member 4, there is formed thereby a yellow toner image. Although the potential of the B filter part lowers due to the adherence of the yellow toner TY, it remains there still as can be seen in the graph of potential E, and in the next development, another toner adheres to this part, thus, there may occur the generation of color turbidness.

FIG. 15(5) shows the state in which corona discharge has been carried out by a charger 9Y on the surface of the image carring member 4 developed by the developing device 8Y, in order to prevent the adherence of other toner on the 8 filter part. The discharge by this charger 9Y is different to the strong discharge by the charger 5 and gives almost no effect to the R and C filter parts, but mainly lowers the potential of the B filter part adhered with yellow toner TY. Consequently, the surface potentials of the image carrying member 4 uniformly shows almost zero. The adherence of other toners in the next development process to the B filter part already adhered with yellow toner TY is prevented and the occurrence of color turbidity is prevented.

Then, when whole surface exposure with green light LG is effected by the exposure device 7G on the surface of the image carrying member 4 shown in FIG. 16(5), where this yellow toner image has been formed, image potential appears this time at the G filter part similarly as described for FIG. 16(3). When this electrostatic latent image is developed by the developing device using magenta toner as the developer. Then, the magenta toner adheres only to the G filter part and a magenta toner image is formed, similarly as in FIG. 16(4). Thereby toner images of two colors have been superimposed. Corona discharge is effected again on this image-formed surface by the charger 9M to lower the potential at the G filter part adhered with the magenta toner and thus to prevent the adherence of other toner on that part. These processes are shown in FIGS. 16(6), 16(7) and 16(8).

Even when the whole surface exposure of red light LR is effected on the surface of the image carrying member 4, on which two colored toner image has been formed, by the color exposure device 7R, since there appears no image potential on the R filter part this time, the electrostatic image thereof is not developed by the developing device 8C using cyan toner as the developer and no cyan toner image is formed. As a result thereof, a red color picture image consisting of clear yellow and magenta without color shift and color turbidity is formed on the image carrying member 4.

Although the above-described FIG. 16 shows the example of the case where positive hole transfer layer is used for the CTL 2*c* of the photoconductive layer 2 of the image carrying member 4, it is of course possible to use an electron transfer layer for the photoconductive layer. In such a case only the positive and negative signs being reversed, the fundamental processes remain all the same. Also, although the surface potential of the image carrying member 4 after charging shown in FIG. 16(2) was made almost zero, it may be shifted to some extent to the negative or the positive.

In Table 1, the relation between the color of the original picture image and the image formation with three primary color toners by the use of the above-described three color separation method is shown. In the table, the mark shows a primary latent image, an electrostatic latent image, and a toner image, and ↓ shows that the state of the upper column is maintained as it is, and the vacant column the state of absence of image. Also, in the adhered toner column shows that no toner adheres, and the marks Y, M, and C respectively show that yellow toner, magenta toner, and cyan toner adhere.

through the charger 6, and next whole surface exposure is effected on the surface of the image carrying member 4 by a blue color of the lamp 7, to form a yellow toner image by developing the potential pattern formed thereby with the developing device 8Y. This toner image passes through without being subjected to the action of the developing device 8M, 8C, and 8Y, the pre-transfer charger 14, transfer electrode 10, separator 11, cleaning device 13, and charger 5. The image carrying member 4 formed with a toner image is subjected to corona discharge when it has reached the position of the charger 6, and the surface potential becomes uniform, and then, is subjected to whole surface exposure by the green light obtained from the lamp 7 to be formed with a potential pattern. Successively, this is developed by the developing device 8M to form a magenta toner image. In the same manner, the uniform formation of surface potential, the formation of potential pattern by a red light, and the development by the developing device 8C are effected. In case when a deeper picture image is desired, after effecting potential smoothing, irradiation with an infrared lamp having high transmittance to white light, toner, and filter is

TABLE 1

| | Original color | | | | | | | | | | | | | | | | | | | | | | | |
|---|---|---|---|---|---|---|---|---|---|---|---|---|---|---|---|---|---|---|---|---|---|---|---|---|
| | White | | | Red | | | Green | | | Blue | | | Yellow | | | Magenta | | | Cyan | | | Black | | |
| Filter layer 3a | R | G | B | R | G | B | R | G | B | R | G | B | R | G | B | R | G | B | R | G | B | R | G | B |
| Image exposure | | | | | ⬡ | ⬡ | ⬡ | | ⬡ | ⬡ | ⬡ | | | | ⬡ | | ⬡ | | ⬡ | | | ⬡ | ⬡ | ⬡ |
| Blue color whole surface exposure | | | | | ↓ | ○ | ↓ | | ○ | ↓ | ↓ | | | | ○ | | ↓ | | ↓ | | | ↓ | ↓ | ○ |
| Yellow development | | | | | ↓ | ● | ↓ | | ● | ↓ | ↓ | | | | ● | | ↓ | | ↓ | | | ↓ | ↓ | ● |
| Green color whole surface exposure | | | | | ○ | | ↓ | | | ↓ | ○ | | | | | | ○ | | ↓ | | | ↓ | ○ | |
| Magenta development | | | | | ● | | ↓ | | | ↓ | ● | | | | | | ● | | ↓ | | | ↓ | ● | |
| Red color whole surface exposure | | | | | | | ○ | | | ○ | | | | | | | | | ○ | | | ○ | | |
| Cyan development | | | | | | | ● | | | ● | | | | | | | | | ● | | | ● | | |
| Adhered toner | — | — | — | — | M | Y | C | — | Y | C | M | — | — | — | Y | — | M | — | C | — | — | C | M | Y |
| Reproduced color | | White | | | Red | | | Green | | | Blue | | | Yellow | | | Magenta | | | Cyan | | | Black | |

Figure 17:
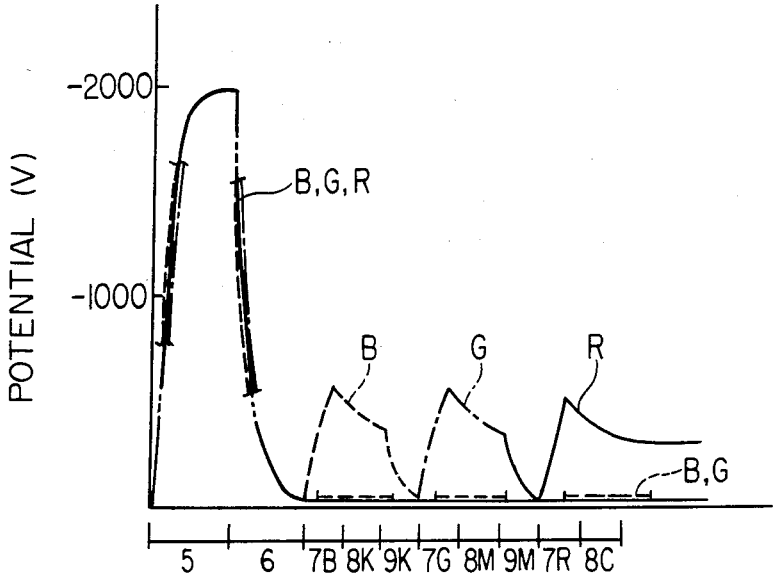
FIG. 17 is a graph for showing in time sequential manner the state of the surface potential of a photoreceptor in accordance to the process.

Further, FIG. 17 shows the manner how the surface potential in respective filter parts, B, G, and R of the photoreceptor changes in accordance with the above-described image forming processes. Numerals on the axis of abscissa, 5, 6, 7B, 8Y, 9Y, 7G, 8M, 9M, 7R, and 8C, respectively show the processes in which the same-marked members in FIG. 14 or FIG. 16 act to the image carrying member 4, and B, G, and R show the highest or average potential of respective filter parts.

Figure 18:
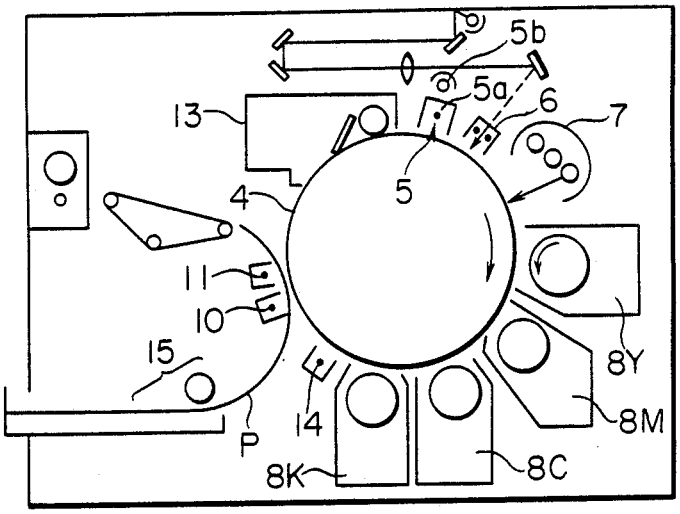
FIG. 18 is a schematic view of another image-forming equipment.

The multi-color image forming equipment shown in FIG. 18 is the one in which one-color toner image is formed per one rotation of the photoreceptor 4. The whole surface exposure is effected by lamps which are provided for blue, green, and red use and are used by changing over or simultaneously, the surface potential of the image carrying memebr 4 after the development being made uniform by utilizing the charger 6 of the image exposure device. Thus, the equipment differs from the multi-color image forming equipment of FIG. 14 in such points as described above. In this multi-color image forming device also, similarly as in the multi-color image forming device of FIG. 14, the same image forming action as described in relation to FIGS. 15 and 16 is effected to enable the formation of multi-color image without color shift and single-color image with excellent image density and resolution. That is, for example, in case when three color image is formed, the image carrying member 4 is charged by uniform exposure with the charger 5*a*, image exposure is effected made by whole surface exposure means 7 to form a potential pattern, and development by the developing device 8K is effected to obtain a color toner image by adding a black toner.

This multi-color image forming equipment has simple construction which is not different from the one of a mono color copying machine except the increased number of developing devices, and has the features of minuaturization and the possibility of attaining low cost. In FIG. 18, the same marks as in FIG. 14 shows the same functioned members.

Figure 19:
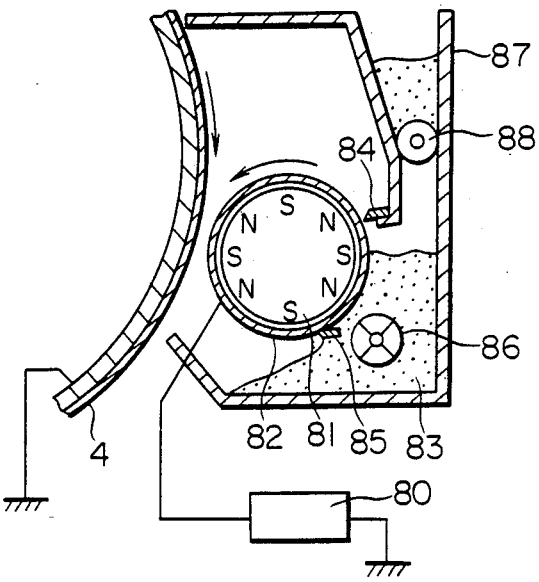
FIG. 19 is a sectional view of a developing equipment.

The developing devices 8Y to 8K in the multi-color image forming equipments shown in FIGS. 14 and 18, there are preferably used the magnetic brush developing device as shown in FIG. 19.

The developing device shown in FIG. 19 transfers the developer adsorbed on the surface of the developing sleeve 81 by the magnetic power of the magnet 82 from the developer reservoir in the direction of the arrow, when at least one of the magnets having developing sleeve 81 and N and S magnetic poles on the inner circumference of the developing sleeve 81 rotates. Then, in the way of transfer of the developer, the transfer amount is readjusted by a transfer amount readjusting blade 84 to form a developer layer, and development is carried out in dependence on the potential pattern of the image carrying member 4 when the developer layer is in the development range where the developing sleeve 81 opposes the image carrying member 4.

In developing, developing bias voltage is applied to the developing sleeve 81 from a bias power source 80. Further, even when development is not effected at need (off time of development), in order to prevent the transfer of toners from the developing sleeve 81 to the image carrying member 4, or from the image carrying member to the developing sleeve 81, bias voltage may be applied on the developing sleeve 81. Further, in the off time of the development, the alternating current bias component at the time of development (on-time) is treated to be cut to make the direct current component only be present, or to be in a floating state, or to be earthed, or to be applied with direct current bias having the same polarity as the toner, or the separate the developing device from the image carrying member. Also, these treatment can be combinedly used. Numeral 85 denotes a cleaning blade which removes the developer layer passed through the developing area from the developing sleeve 81 to return to the developer reservoir 83, numeral 86 a stirring device for stirring the developer to become uniform and, together with that, for making the toner be rubbed and charged, and numeral 88 a toner supply rolelr for supplying toner from the toner hopper 87 to the developer reservoir 83.

The developer to be used in such developing device may be the so-called one component developer consisting of the toner only or a two component developer consisting of the toner and a magnetic carrier. In developing, a method of directly rubbing the developer layer or image carrying surface with a magnetic brush may be employed, but in order to avoid the damage of the formed toner image, and particularly after the second development, the developing system in which the developer layer does not touch the image holder surface such as, for example, the systems disclosed in the specification of U.S. Pat. No. 3,893,418 or Japanese patent publication Laid-Open, No. 18656/80, and the systems disclosed in respective specifications of the Japanese patent application No. 57446/83, ibid. No. 238295/83, and ibid. No. 238696/83 are preferably used. Among these systems, the one in which one-component or two component developer containing non-magnetic toner which can freely select coloring is used, and forms an alternating electric field and can effect development without contacting the electrostatic image carrying member with the developer layer is preferable. This non-contact development carries out development by establishing the gap between the developing sleeve and the photoreceptor surface wider than the layer thickness of the developer layer on the developing sleeve (but, in a state where no potential difference exists between both members), and the development is effected under the various conditions as decribed above and at such a gap and layer thickness.

As the toner for use is development can be employed electrostatic toners which has been produced by known technology comprising known binder resins used in general for toners, organic and inorganic pigments, various kinds of coloring agents, and various kinds of magnetic additives, etc. As the carrier can be used various known carriers such as iron powder used generally for electrostatic images, ferrite powder, magnetic carriers made by resin coating on them, or made by dispersing magnetic material in a resin.

Further, the developing methods disclosed in the specifications of Japanese patent No. 249669 and ibid. No. 240066 which were previously applied by the applicant of the present invention may be used.

In the present invention, as the charger for use in treating to charge the image carrying surface, which has been subjected to development before the whole surface exposure of every time after the second one, a charger for effecting deviated or not deviated alternating corona discharge, or a direct current charger is used. Especially, in the case of the direct current charger, the Scorotron charger having a grid capable of controling charging potential is more preferable than the Corotron charger having charging wire only, and as the charging potential, the one which is approximately the same potential as that at the time of finish of the secondary charging simultaneous image exposure is preferable. For example, when the potential at the time of finish of the second charging simultaneous exposure process is about 0 volt and the potential at the toner adhering part deviates to positive, the potential of the grid of the Scorotron charger is better to be made approximately equal to 0 volt (for example, earthed), and the charging wire is applied with negative potential.

As the effect of such charging treatment, can be obtained, other than the already described effect of preventing the adherence of other toner on the same part as in the previous development by making the residual potential of the part adhered with the toner in the previous development be lowered sufficiently, the effect of preventing the uprise of potential of the surface of the photoreceptor by the dark attenuation of the potential, as well as the effect of giving to the toner a charge amount sufficient for making the toner image be transferred afterwards. As to such facts, in order to compare with the Examples of the present invention described by referring to FIGS. 14 and 16, 3-colored picture image formation was effected under the same conditions except that the chargers 9Y and 9M directly after the developing devices 8Y and 8M were removed, but the obtained recorded picture images showed bad coloring and were very inferior in comparison to the original picture image. In contrast to that, in case when the picture image formation was effected according to the above-described Example of the present invention, not only a recorded picture image having clear colors with almost the same coloring as that of the original picture image could be obtained but also could obtain the effect that the transfer rate of the toner rised and the toner amount recovered in the cleaning device 13 also decreased.

As is evident from the above-described fact, the charging treatment process with the purpose of equalization before development is extremely important in order to obtain a good multi-color image.

To be more concrete, in the picture image forming equipment of FIG. 14, the image carrying member 4 was designed to comprise the layer construction photoreceptors of FIG. 4, and the photoconductive layer 2 was formed to have the layer construction consisting of the materials as shown in Table 2 described below. The total thickness of the photoreceptor was about 32 μm, and the transparent insulating layer 3 was made of polyethylene film with thickness of 20 μm. The filter layer 3*a* had the distribution of R, G, and B filter parts, whose $1_1$ and $1_2$ were both 200 μm. The image holder 4 having diameter of 200 mm was rotated at the linear velocity of 50 m/sec in the direction of the arrow.

TABLE 2

| First charge generating layer 2a | | Charge transfer layer 2c | | Second charge generating layer 2b | |
|---|---|---|---|---|---|
| Copper phthalocyanine | 30% by weight | Oxadiazole | 50% by weight | Diisazo dye | 50% by weight |
| Oxadiazole | 40% by weight | Vinylchloride-vinylacetate copolymer resin | 50% by weight | Oxadiazole | 25% by weight |
| Vinylchloride-vinylacetate copolymer resin | 30% by weight | | | Vinylchloride-vinylacetate copolymer resin | 25% by weight |
| Thickness | 1 μm | Thickness | 30 μm | Thickness | 0.7 μm |

While irradiating white light to this image carring member 4 from the light source 5*a;* the surface potential of the image carring member 4 was made to be −1.5 kV after charging of the charger 5*b* by the Corotron charger. After discharging the charger of the image exposure device 6 by the Scorotron charger, the surface potential of the image holder was made be −50 V. Respective developing devices 8Y to 8C were made as magnetic brush developing devices for transferring the developer layers by making the developing sleeve with diameter of external diameter of 25 mm and consisting of non-magnetic stainless steel rotate to the left at the rotating speed of 153 rpm and the magnetic body in the inner part have 8 poles of the magnetic pole giving magnetic flux density of 800 G at maximum and rotate to the right at the rotation speed of 800 rpm. The surface gap between the image carrying member and the developing sleeves of respective developing devices 8Y to 8C was made as 1 mm. In respective developing devices 8Y to 8C, a developer made by mixing toners having colors of yellow, magenta, and red, respectively, and average particle diameter of 5 μm and friction charging amount of +19 to 20 μc/b and a carrier consisting of a resin containing, in a dispersed state, a magnetic material powder having average particle diameter of 25 μm and specific resistance of $10^{22}$ Ωcm were mixed in a weight ratio of 1:4, was used. The thickness of the developer layer formed on the sleeves of respective developing devices 8Y to 8C was made as 3.5 mm. The gap between the image carrying member and the developing sleeve was made as 0.7 mm. When respective developing devices effect development, a developing bias superposed with direct current voltage of −100 V and alternating current voltage having virtual value of 1 kV and frequency number of 2 kHz was applied on the developing sleeve. The smoothing by means of the chargers 9Y and 9M was effected, as the first example, under a condition that direct current of −50 V was applied on a back plate and alternating current of 6 kV on the charging pole 6 kV, and as the second example, under a condition that the back plate was earthed and a direct current of +5.5 KV was applied on the charging pole to make the grid voltage −50 V. Under such conditions, copying of 3-colored image was effected to find in either of first and second examples, no color shift, and a picture image with good color reproduction and being extremely clear could be obtained. By the way, obtained respective potential contrast was 300 to 500 V for the whole surface exposure by exposure by respective specified light.

Although the above-described explanations were all related to examples of color copying machines using the so-called 3-color separation filters and 3-color toners, the present invention is not limited to the illustrated examples, and it is needless to say that the combination of number of kinds and color of the separation filters and the combination of colors of the toners corresponding thereto can also be selected corresponding to the purpose, for example, the process for obtaining 2-color copy is also conceivable.

Further, the term "charging" in the explanation given up to here includes the case in which the surface potential of the photoreceptor became zero, or the case where the charge on the surface vanished, when charging was effected.

Further, in the above-described explanation, the spectral characteristics of the light for use in whole surface exposure are obtained by the use of the green (G), blue (B), and red (R) filters, the one obtainable by means other than the filter is also suitable, and the spectral characteristics are not limitted to those of G, B, and R, and what is essential is that the spectral characteristics are such that an electrostatic latent image is formed on the specified filter part corresponded to specified light (not limitted to one kind) on the photoreceptor.

Further, the image forming method of the present invention comprises a method which forms electrostatic latent image simultaneously with the primary charging in such a way as uniform exposure secondary charging → image exposure → third charging, and next, the potential pattern formation at a specified filter part by specified light and the development are repeated.

The uniform exposure simultaneous with the primary charging has the purpose of injecting charge in the photoreceptor layer, and can be separately effected. That is, even the uniform exposure is effected after the primary charging, the same effect can be produced.

As explained above, the photoreceptor according to the present invention is constructed with a photoconductive layer comprising plural number of layers including charge generating materials and a layer including charge transporting materials, an insulating layer, and a layer consisting of plural kinds of color separation filters, and the picture image forming method according to the present invention is constituted as such that the photoconductive layer constructed as described above is subjected to image exposure through a layer consisting of plural kinds of color-separation filters, and thereafter forms potential pattern on the part corresponding to the above-described color separation filters by effecting whole surface exposure by a specified light and then effects development, so that the following effects can be expected.

(i) Since a layer consisting of plural kinds of color separation filters is employed, a latent image per color can be formed by image exposure of once to cause no color shift and no color turbidity and can obtain high quality images in high speed and simply.

(ii) By constituting a photoconductive layer to comprise plural number of layers as described above, charge can be separately generated on different layers and the use of a photoconductive layer with a laminated structure becomes possible. As a result, the width of selection range of respective layers constituting the photoreceptor becomes wide and the restriction on the design is little, and moreover, it becomes possible to make the charge holding ability high and to make the spectral sensitivity high, and the balance becomes easily obtained to enable the formation of more good quality images.

Table 3

In an example of a receptor of a specified condition, an extremely clear picture image with sufficient potential contrast, good optical sensitivity and color reproduction could be obtained. Respective potential contrast obtained can be considered from developing properties to be not less than 200 V or preferably 300 to 500 V for the whole surface exposure by respective specified light.

the fact that the latter shows similar physical properties except it shows photoconductive properties.

Further, in Table 3, when the optical sensitivity was examined, it lowers as the thickness of the photoconductive layer becomes thicker, and when further the potential contrast was examined, it was known that the tinner the photoconductive layer is, and thicker the insulating layer is, the samller the potential contrast. Finally, when the examination was carried out on the dark attenuation, it was clarified that the thinner the insulating layer is, the larger potential contrast can be obtained, but the larger becomes the dark attenuation.

By the way, the dark attenuation is preferably not

TABLE 3

| | | Film thickness of photoconductive layer $d_2$ (μm) | | | | | | | | | | | | | | | | | | | | | | | |
|---|---|---|---|---|---|---|---|---|---|---|---|---|---|---|---|---|---|---|---|---|---|---|---|---|---|
| | | 5 | | | 10 | | | 20 | | | 30 | | | 40 | | | 50 | | | 75 | | | 100 | | |
| Film thickness of insulating layer $d_1$ (μm) | 5 | o | x | x | o | Δ | x | o | o | x | o | o | x | o | o | x | Δ | o | Δ | x | o | o | x | o | o |
| | 10 | o | x | x | o | Δ | Δ | o | o | o | o | o | o | o | o | o | Δ | o | o | x | o | o | x | o | o |
| | 20 | o | x | x | o | Δ | Δ | o | o | o | o | o | o | o | o | o | Δ | o | o | x | o | o | x | o | o |
| | 30 | o | x | x | o | x | Δ | o | o | o | o | o | o | o | o | o | Δ | o | o | x | o | o | x | o | o |
| | 40 | o | x | Δ | o | x | o | o | Δ | o | o | Δ | o | o | o | o | Δ | o | o | x | o | o | x | o | o |
| | 50 | o | x | Δ | o | x | o | o | x | o | Δ | x | o | Δ | x | o | x | o | o | x | o | o | x | o | o |
| | 75 | x | x | Δ | x | x | o | x | x | o | x | x | o | x | x | o | x | x | o | x | x | o | x | o | o |
| | 100 | x | x | Δ | x | x | o | x | x | o | x | x | o | x | x | o | x | x | o | x | x | o | x | x | o |

In the above Table, the left side of each column denotes sensitivity, the middle one potential contrast, and the right side dark attenuation (potential change of black base part after the secondary charging). In each column, mark o means good, mark x means bad, and mark means Δ that there is no obstacle in practical use.

As to the results shown in the above-described Table, even though the thickness of the charge-generating layer, the filter material other than the one already shown or the photoconductive layer material is changed, there was obtained the same result.

more than 200 V/sec, and particularly, not more than 100 V/sec when it should be able to be used in usual copying processes. Also, for the potential contrast to be obtained, the change after 1 second (ΔV/V) is preferably not more than 30%, and particularly not more than 30%.

Next, when the conductive substrate is made as to have the construction capable of injecting charge and is under the conditions described in the following Tables 4 and 5, similar experiments are carried out and similar results as shown in Table 3 are obtained.

TABLE 4

| Conductive substrate | | Charge transfer layer 2c | | Second charge transfer layer 2b | |
|---|---|---|---|---|---|
| | | Oxadiazole | 50% by weight | Disazo dye | 50% by weight |
| Conductive carbon | 70% by weight | Vinylchloride-vinylacetate copolymer resin | 50% by weight | Oxadiazole | 25% by weight |
| Vinylchloride-vinylacetate | 30% by weight | | | vinylchloride-vinylacetate copolymer resin | 25% by weight |
| Thickness | 10 μm | Thickness (as shown in the following | | Thickness | 0.7 μm |

TABLE 5

| Conductive substrate | | Charge transfer layer 2c | | Second charge generating layer 2b | |
|---|---|---|---|---|---|
| | | Polyvinylcarbazole | 50% by weight | Copper phthalocyanin | 50% by weight |
| Conductive carbon | 70% by weight | Vinylchloride-vinylacetate copolymer resin | 50% by weight | Polyvinylcarbazole | 25% by weight |
| Vinylchloride-vinylacetate copolymer resin | 30% by weight | | | vinylchloride-vinylacetate copolymer resin | 25% by weight |
| Thickness | 5 μm | Thickness (as shown in the following) | | Thickness | 0.7 μm |

Note:
$d_2$(μm) = charge transfer layer thickness 2c + 1(μm)

This fact leads to such consideration as follows:

(1) Filter materials should comprise binder resins, dyes, or pigments, which have similar dielectric constant (generally, of the order of 1 to 4) and high resistance;

(2) Photoconductive layer materials should also comprise binder resins and dyes or pigments, and have similar dielectric constant (generally, of the order of 2 to 4) and high resistance;

(3) Filter materials and photoconductive materials also can be considered to have low dependency from In the above-described explanation, all were described in relation to the so-called 3-color separation filters and a color copying machine employing three original-color toners, but the present invention is not limitted to the illustrated examples, and it is needless to say that the kind, number, colors, and the toner corresponding thereto can be optionally selected in correspondence to the purpose. For example, a process for obtaining 2-colored copy can also considered.

Further, the term "charging" in the explanation heretofore given, includes also such a case that when charging has been done, the surface potential of a photoreceptor becomes zero, or the charge on the surface vanishes.

Moreover, in the above-described explanation, the spectral characteristics of the light for the whole surface exposure can be acquired by use of a filter employing the green (G), blue (B), and red (R) filters, but those obtained by means other than the filters may be also employed, and the spectral characteristics are not limitted to those of G, B, and R, so that the essential point is such that the spectral characteristics which forms a latent image on the specified filter part (not limitted to one kind) corresponding to a specified light on the photoreceptor by means of a specified light may be used.

Further, the picture image forming method of the present embodiment forms electrostatic latent image in such a way as that simultaneously with the primary charging, the processes of uniform exposure—secondary charging—image exposure—tertiary charging are employed, and then, the formation of potential patterns by a specified light at a specified filter part and the development are repeated (Japanese patent application No. 229524/85).

In this process, the dark attenuation is defined by the potential change at the image picture black part after the tertiary charging.

Also, the uniform exposure simultaneous with the primary charging has the object of injection charge into the photoreceptor layer and can be separately carried out. That is, the same effect can be produced by effecting the uniform exposure before or after the primary charging.

As explained above, the photoreceptor according to the present invention is constructed with a layer containing charge generating materials, a photoconductive layer containing charge transporting materials, and an insulating layer comprising plural kinds of color-separation filters, and the picture image forming method according to the present invention carries out image exposure of the photoconductive layer constructed as described above by passing it through a filter layer comprising plural kinds of filters, and subsequently applies whole surface exposure by a specified light to form potential pattern on the part corresponding to said color-sepration filter to carry out development, so that the following effects can be attained:

(i) As a layer comprising plural kinds of filters is employed, latent image per color can be formed by image exposure of once to cause no color shift and no color turbidity and a high quality image can be obtained at high speed and simply.

(ii) By constructing a photoconductive layer in such a manner as to comprise plural number of layers as described above, functions can be allotted to different layers per procss and the use of photoconductive layer of laminated structure is made possible. As a result, the width of the material selection becomes wide to make the restriction on the design few, and moreover, the charge holding ability of the photoconductive layer can be made high and the balance becomes to be easily attained.

What is claimed is:

1. A photoreceptor for electrophotography comprising a photoconductive layer comprising a layer containing a charge generating material and a layer containing a charge transporting material, an electrically insulating layer at one side of said photoconductive layer, having a uniform electric charge thereon, an electrically conductive layer disposed at the other side of said photoconductive layer, and a color separation filter layer having plural kinds of color separation filters being juxtaposed in a predetermined arrangement, said color separation filter layer disposed at one side of said photoconductive layer whereby said photographic layer is imagewise exposed through said color separation filters.

2. The photoreceptor of claim 1 wherein said electrically insulating layer is transparent to the imagewise exposure and said color separation layer is electrically insulated, and wherein both said electrically insulating layer and said color separation filter are disposed at the same side of said photoconductive layer.

3. The photoreceptor of claim 2 wherein said electrically insulating layer, said color separation filter layer, said photocondutive layer, and said electrically conductive layer are superposed in that order.

4. The photoreceptor of claim 2 wherein said color separation filter layer, said electrical insulating layer, said photoconductive layer, and said electrically conductive layer are superposed in that order.

5. The photoreceptor of claim 2 wherein said electrically insulating layer and said color separation filter layer form a layer group which comprises at least two electrically insulating layers and sandwiches said color separation filter therebetween, and wherein said layer group, said photoconductive layer, and said electrically conductive layer are superposed in that order.

6. The photoreceptor of claim 1, wherein said electrically conductive layer is transparent to the imagewise exposure, and wherein both said electrically conductive layer and said color separation filter are disposed at same side of said photoconductive layer.

7. The photoreceptor of claim 6, wherein said electrically insulating layer, said photoconductive layer, said electrically conductive layer, and said color separation filter layer are superposed in that order.

8. The photoreceptor of claim 7 wherein said color separation layer is electrically insulated.

9. A photoreceptor for electrophotography comprising a photoconductive layer comprising a layer containing a charge generating material and a layer containing a charge transporting material, a color separation filter layer having plural kinds of color separation filters being juxtaposed in a predetermined arrangement, said color separation filter layer being electrically insulated and disposed at one side of said photoconductive layer, and an electrically conductive layer disposed at the other side of said photoconductive layer.

10. The photoreceptor of claim 1, wherein the thickness of the photoconductive layer ($d_2$) and the thickness of the insulating layer ($d_1$) satisfies the following relation:

$0.25 \leqq d_1/d_2 \leqq 2$

11. The photoreceptor of claim 1, wherein the color separation filter comprises at least one of red, green and blue filters.

12. The photoreceptor of claim 1, wherein the color separation filter comprises at least one of cyan, magenta and yellow filters.

13. The photoreceptor of claim 11, wherein the color separation filter consists of red, green and blue filters.

14. The photoreceptor of claim 12, wherein the color separation filter consists of cyan, magenta and yellow filters.

15. The photoreceptor of claim 1, wherein said insulating layer has a resistance not less than $10^{13}$ Ω· cm.

16. The photoreceptor of claim 1, wherein said insulating layer is said layer having a pattern of said color separation filter.

17. The photoreceptor of claim 1, wherein said pattern is either of stripe or of mosaic consisting of red, green and blue filters.

18. The photoreceptor of claim 1, wherein said charge generating material-containing layer consists of two layers and said charge transporting material-containing layer is provided between said charge generating material-containing layers.

19. The photoreceptor of claim 1, wherein said charge transporting material-containing layer contains a charge generating material.

20. The photoreceptor of claim 10, wherein said insulating layer has a layer thickness of 10 to 40 μm.

21. The photoreceptor of claim 10, wherein said photoconductive layer has a layer thickness of 15 to 50 μm.

22. The photoreceptor of claim 20, wherein said photoconductive layer has a layer thickness of 15 to 50 μm.

23. The photoreceptor of claim 1, wherein said layer having a pattern of a color separation filter distributed therein has been prepared by printing, photoetching or vapor deposition mehtod.

24. The photoreceptor of claim 17, wherein said pattern is is a repeating pattern having a repeating cycle of 10 to 500 μm.

25. The photoreceptor of claim 24, wherein said repeating cycle is 30 to 300 μm.

26. A method of forming an electrophotographic image on a photoreceptor for electrophotography characterized in that said method comprises (a) a step of providing a uniform electric charge on an insulating surface of a photoreceptor which comprises an electrically conductive layer, a photoconductive layer comprising a layer containing a charge generating material and a layer containing a charge transporting material, and a layer having a pattern made of a color seperation filter distributed therein, provided that at least one surface layer of the photoreceptor is made electrically insulating, (b) a step of imagewise exposing said photoreceptor to light from the side of the layer having plural kinds of color separation filter portion, (c) a step of uniformly exposing said photoreceptor to a specific color light to form an electric potential pattern on said photoreceptor corresponding to a specific color separation filter portion, and (d) a step of developing said electric potential patten.

27. A method of forming an electrophotographic image on a photoreceptor for electrophotography characterized in that said method comprises (a) a step of providing a uniform electric charge on an insulating surface of a photoreceptor which comprises an electrically conductive layer, a photoconductive layer comprising a layer containing a charge generating material and a layer containing a charge transporting material, and a layer having a pattern made of a color seperation filter distributed therein, provided that at least one surface layer of the photoreceptor is made electrically insulating, (b) a step of imagewise exposing said photoreceptor to light from the side of the layer having plural kinds of color separation filter portion, (c) a step of uniformly exposing said photoreceptor to a specific light to form an electric potential pattern on said photoreceptor corresponding to a specific color separation filter portion, and (d) a step of developing said electric potential patten, and (e) a step of repeating steps (a) through (d).

28. The method of claim 27, wherein the thickness of the photoconductive layer ($d_2$) and the thickness of the insulating layer ($d_1$) satisfies the following relation:

$0.25 \leqq d_1/d_2 \leqq 2$

29. The method of claim 27, wherein the color separation filter comprises at least one of red, green and blue filters.

30. The method of claim 27, wherein the color separation filter comprises at least one of cyan, magenta and yellow filters.

31. The method of claim 29, wherein the color separation filter consists of red green and blue filters.

32. The method of claim 31, wherein the color separation filter consists of cyan, magenta and yellow filters 33. The method of claim 32, wherein said insulating layer has a resistance not less than $10^{13}$ Ω· cm.

34. The method of claim 27, wherein said insulating layer is said layer having a pattern of said color separation filter.

35. The method of claim 27, wherein said pattern is either of stripe or of mosaic consisting of red, green and blue filters.

36. The method of claim 27, wherein said pattern is an irregular or a regular pattern.

37. The method of claim 27, wherein said charge generating material-containing layer consists of two layers and said charge transporting material-containing layer is provided between said charge generating material-containing layers.

38. The method of claim 27, wherein said charge transporting material-containing layer contains a charge generating material.

39. The method of claim 28, wherein said insulating layer has a layer thickness of 10 to 40 μm.

40. The method of claim 28, wherein said photoconductive layer has a layer thickness of 15 to 50 μm.

41. The method of claim 39, wherein said photoconductive layer has a layer thickness of 15 to 50 μm.

42. The method of claim 27, wherein said layer having a pattern of a color separation filter distributed therein has been prepared by printing, photoetching or vapor deposition method.

43. The method of claim 35, wherein said pattern is is a repeating pattern having a repeating cycle of 10 to 500 μm.

44. The method of claim 43, wherein said repeating cycle is 30 to 300 μm.

* * * * *